US006805036B2

(12) United States Patent
Malakatas

(10) Patent No.: US 6,805,036 B2
(45) Date of Patent: Oct. 19, 2004

(54) METHOD AND DEVICE FOR JUDGING THE AIMING ERROR OF A WEAPON SYSTEM AND USE OF THE DEVICE

(75) Inventor: Nicolas Malakatas, Zürich (CH)

(73) Assignee: Oerlikon Contraves AG, Zurich (CH)

( * ) Notice: Subject to any disclaimer, the term of this patent is extended or adjusted under 35 U.S.C. 154(b) by 0 days.

(21) Appl. No.: 10/302,526

(22) Filed: Nov. 22, 2002

(65) Prior Publication Data

US 2003/0140866 A1 Jul. 31, 2003

(30) Foreign Application Priority Data

Nov. 23, 2001 (CH) ..... 2167/01

(51) Int. Cl.[7] ..... F41G 3/00
(52) U.S. Cl. ..... 89/41.01; 89/41.05; 89/41.17
(58) Field of Search ..... 89/1.11, 41.01, 89/41.03, 41.04, 41.05, 41.07, 41.14, 41.17, 41.22, 204, 205

(56) References Cited

U.S. PATENT DOCUMENTS

| | | | | |
|---|---|---|---|---|
| 3,981,010 A | | 9/1976 | Michelsen | |
| 4,145,952 A | * | 3/1979 | Tye | 89/41.21 |
| 4,402,250 A | * | 9/1983 | Baasch | 89/41.11 |
| 4,429,993 A | | 2/1984 | Schick | |
| 4,878,752 A | | 11/1989 | Bramley | |
| 5,208,418 A | | 5/1993 | Toth | |
| 5,464,174 A | * | 11/1995 | Laures | 244/3.11 |
| 6,491,253 B1 | * | 12/2002 | McIngvale | 244/3.11 |
| 6,584,879 B2 | * | 7/2003 | Gorman | 89/1.11 |
| 2001/0047248 A1 | | 11/2001 | Toth | |

FOREIGN PATENT DOCUMENTS

| | | | | |
|---|---|---|---|---|
| EP | 1 152 206 A1 | | 11/2001 | |
| GB | 2077400 A | * | 12/1981 | F41G/3/00 |
| WO | WO 88/08952 | | 11/1988 | |

* cited by examiner

*Primary Examiner*—Harold J. Tudor
*Assistant Examiner*—Gabriel S. Sukman
(74) *Attorney, Agent, or Firm*—McCormick Paulding & Huber LLP

(57) ABSTRACT

A method and device for judging the aiming error of a weapon system and a use of the device are disclosed. The weapon system includes a fire control device (F) for tracking a target (Z), a weapon (W) having a weapon barrel (B), aiming means for aiming the weapon barrel (B), and a data processing facility (EDV). The fire control device (F) continuously tracks the target (Z). An image recording device (V) moved in solidarity with the weapon barrel (B) record images of the target (Z) and its surroundings. An image reproduction device (M) displays the images recorded by the image recording device (V) and a mark (X). The mark (X) represents an aiming line, a deviation (a) of the target (Z) from the mark (X) representing the aiming error of the weapon system. The fire control device (F) performs the aiming of the weapon barrel (B) on the basis of a lead calculation, which takes the movement of the target (Z) into consideration. The device may be used for fixed and mobile weapon systems.

25 Claims, 3 Drawing Sheets

METHOD AND DEVICE FOR JUDGING THE AIMING ERROR OF A WEAPON SYSTEM AND USE OF THE DEVICE

CROSS REFERENCE TO RELATED APPLICATION

Applicant hereby claims foreign priority under 35 U.S.C. § 119 from Swiss Patent Application No. 2001 2167/01, filed 23 Nov. 2001, the disclosure of which is herein incorporated by reference.

BACKGROUND OF THE INVENTION

The present invention relates to a method and device for judging the aiming errors of a weapon system, which has a fire control device for tracking a target, a weapon having a weapon barrel, aiming means for aiming the weapon barrel, and a data processing facility having software.

Methods and devices of this type are used for the purpose of judging the aiming precision of weapon systems, which are used to combat rapidly moving targets, generally flying targets.

Such weapons systems include a fire control device and one or more guns assigned to the fire control device. The fire control device is intended for the purpose of detecting a target, acquiring it, and tracking it. During tracking of the target, measurements are performed almost continuously, i.e., at measurement instants lying very near one another in time, in order to establish the location of the target for each measurement instant. A data processing facility assigned to the weapon system retrospectively calculates the movement state of the target from the results of these measurements, this movement state understood to include at least one empirical travel/time function, one empirical speed/time function, and one acceleration/time function of the target. Furthermore, the computer unit calculates the future movement state of the target on the basis of the travel/time function, the speed/time function, and the acceleration/time function. This is an extrapolation, i.e., the actual future movement state of the target is not calculated, but rather the movement state which the target will presumably have and which is also referred to as the expected movement state of the target. In particular a due instant and an associated due position, at which the target is expected at the due instant, are calculated. The due position is determined in such a way that a shell which is fired at a specific firing instant by the weapon arrives at the due position at the due instant or, expressed simply, hits the target at the due position. The due position determined in this way is therefore the expected meeting point. In connection with this, the data processing unit also calculates an aiming point for the weapon and/or for the weapon barrel, at which the weapon barrel must be aimed in the firing instant, and/or an azimuth and an elevation which the weapon barrel must have in the firing instant. In this calculation, which is referred to as a lead calculation, the relative positions of the fire control device and the weapon, the internal and external ballistics, and delays, which result during the functioning of the system, are taken into consideration. Obviously, the firing instant, in which the weapon barrel must be aimed at the aiming point, is before the due instant, in which the target will be located at the due position.

In order to judge the serviceability of the weapon system, the aiming precision of the weapon system, which largely determines the accuracy performance, is tested. In this case, it is essentially checked whether the procedures between the tracking of the target and the firing of a shell run as planned, specifically in such a way that the target and shell are located at the due position in the due instant, or at least in its close surroundings. Various methods are known for determining aiming errors. However, really appropriate judgment of the accuracy performance of a weapon system is only possible if the combating of a target is actually performed or is simulated in a way close to reality.

Precise judgment of the aiming precision and/or precise determination of aiming errors may be performed, for example, by actually firing at a target and determining the angular and/or distance deviation of the shell from the target during its flight. However, the judgment of the aiming precision and/or the accuracy performance is restricted to a relatively narrow time window during shelling and does not provide any points of reference about possible hits during the remaining span of time in which the target may be combated by the weapon used. A manipulated target and/or practice target is used as the target, which is to behave at least approximately like the real targets which the weapon system is intended to combat. Such manipulated targets are unmanned. Self-flying manipulated targets, which are remote-controlled, are known, as are non-flying manipulated targets, which are, for example, pulled by a towing aircraft. Live ammunition or practice ammunition may be used as ammunition. The deviation may be established in two different ways: either the travel/time curves of both the manipulated target and shell are determined and the deviation of the shell from the manipulated target is established therefrom; for this purpose, for example, the localized region in which the manipulated target and the shell meet may be imaged in the time period in which this impact occurs and the deviation may be determined therefrom. Or, sensors are attached to the manipulated target, which react to shells flying by. The great disadvantage of this method is that it is very complicated and costly. Independently of whether self-flying or towed manipulated targets are used, these manipulated targets themselves are necessary, as well as either additional devices for establishing and measuring the flight paths and for evaluating the measurement values established in this case, or devices for processing the signals made available by the sensors. The use of unmanned, flying, remote-controlled manipulated targets requires additional terrestrial devices for remote control of these manipulated targets. The totality of the devices required is, in any case, as indicated above, costly to provide and complicated to operate; typically, these devices may only be operated by specialized personnel and require an infrastructure which is only available at fixed firing ranges, but not in the field. In addition, there is always the danger of damaging or destroying the manipulated targets, which may not be avoided and should not be avoided, since hitting the manipulated target documents precisely the good aiming precision which is sought.

While in the method described above, manipulated targets are used as targets and real flight paths actually flown through by shells are assigned for the judgment, in the method described in the following, known as "zero test", real targets or manipulated targets may be used as desired; the flight paths of the shells are optically simulated, the simulated beams only corresponding to the simulated shell flight paths at their starting and ending points. The zero test only verifies whether the tracking of the target by the fire control device and the aiming of the weapon barrel controlled by the fire control device at the target runs without errors, but the actual lead calculation is not checked.

For the zero test, the tracking of the target is performed as usual by the fire control device. The weapon barrel is continuously tracked on the target in such a way that it is continuously aimed at the target. The target is not fired upon, but rather a video camera mounted on the weapon barrel records images of the target. These images are displayed immediately or later. The aiming line, i.e., a line in the extension of the weapon barrel axis, is represented in the visualized images by a mark. The aiming error appears as a deviation of the image of the target from this mark. The target, which may be a real target in the zero test, is therefore not fired upon using shells, but rather the shelling is simulated in a way by optical beams; however, during the simulation a beam is recorded and visualized which runs not from the weapon to the target, but from the target to the weapon, this, however, being unimportant for the method. During the zero test, the weapon is directly tracked on the target, i.e., azimuth and elevation are such that for perfect aiming precision, the weapon barrel is aimed directly at the target; during visualization of the images of the video camera, the target is always on the mark. Since in reality the aiming precision is not perfect, because certain aiming errors almost always occur, the image of the target is generally not on the mark during visualization of the images of the video camera. The deviation of the image of the target from the mark corresponds to the deviation of the shell from the target. The zero test is based on the fiction that shells without mass are used, which pass through their flight path with infinite shell speed, so that the shell flight time from the weapon barrel to the target is zero, which also explains the name "zero test". Lead and the inclusion of internal ballistic variables of the shell are not taken into consideration by the data processing unit assigned to the weapon system in the calculations of azimuth and elevation and/or the control of the weapon barrel; they also actually do not play a role within the fiction of the infinite shell speed. The advantage of the zero test is that the additional devices necessary are not costly, and the performance of the test is simple, so that no specialized personnel have to be used; the test may be performed not only on firing ranges, but also in the field. The simplifications which occur for the zero test, i.e., the masking of all facts which are connected to the lead calculation, are simultaneously the disadvantages of the zero test.

It is therefore the object of the present invention, to indicate a method of the type initially cited which avoids the disadvantages of the related art; on one hand, the new method is to be more cost-effective in regard to the devices necessary for this purpose and simpler in regard to its performance than typical methods, in which a manipulated target and real shells are used; on the other hand, the new method, unlike the previously known zero test, is also to take all facts in connection with the lead calculation into consideration;

to suggest a device for performing such a method, and to indicate a use of the new device.

The individual steps of the method may also be performed at least partially in other sequences.

SUMMARY OF THE INVENTION

In the new method, as in the typical zero test, real targets or manipulated targets are used, and shells and/or their flight path—or more precisely, the beginning and end of the flight path—are optically simulated; however, in contrast to the typical zero test, a lead calculation is performed. Therefore, it is not only tested whether the weapon barrel precisely follows the tracking fire control device, but rather the precision of the lead calculation is also considered in the test. The advantages achieved therewith are essentially as follows:

Although a more comprehensive test result may be achieved, no additional devices are necessary, in comparison to the zero test, to perform the test.

The method is not complicated to perform; the aid of specialists is not necessary and the method may also be performed outside of firing ranges.

The method is environmentally acceptable; there is no damage to the target, and no ammunition is used; therefore, acoustic emissions are also dispensed with.

The new method is very cost-effective and simple to perform, however,—like the typical zero test—it is only a test method, which provides information about the totality of the aiming errors, including the lead calculation. The method therefore does not allow any diagnoses about the causes of the aiming errors. Corrections of the aiming errors may therefore only be performed by error compensations, but not by eliminating the causes of the errors. However, this does not reduce the value of the method, since, in the final analysis, only the effect of the weapon system is significant, and it is unimportant whether aiming errors are to be corrected through their causes or by compensation.

The new method includes the following steps:

A retrospective calculation of the movement states of the target is performed on the basis of multiple measurements, i.e., essentially an empirical travel/time curve, an empirical speed/time curve, and an acceleration/time function of the target are determined.

An extrapolating calculation of future movement states of the target is performed on the basis of the retrospective calculation of the movement states of the target, i.e., a presumed future travel/time curve of the target is determined.

Value pairs of due instants and due positions are recorded, namely due instants, in which the target will be located at a specific position and due positions, where the target will presumably be located at the associated due instants.

Each due position is determined for a specific firing instant, taking into consideration the shell speed and the internal ballistic values of the shell, in such a way that a shell which is fired from the weapon at this firing instant would arrive at the due position at the due instant.

The weapon barrel is now adjusted in regard to elevation and azimuth in such a way that it is aimed at the associated due position at each due instant. The aiming of the weapon barrel at the due positions may be performed in an aiming instant shortly before the due instant, but is preferably performed in the due instant.

The image recording device records the due position and its surroundings continuously or intermittently, but particularly at the due instant or at least in the time very near it; the images recorded in this case are displayed using the image reproduction device.

At the due instant, the shell fired would be located in the due position and the target will presumably be located in the surroundings of the due position. The due position is represented by a mark in the image of the image reproduction device and the actual target is imaged. The interval between the mark and the image of the target corresponds to the deviation of the shell, which would have been fired by the shell flight time before the due instant, aimed toward the due position.

As explained in more detail above, only the shells [sic] corresponding to internal ballistics are taken into consideration for the calculation of the flight behavior of the shell to be simulated. This is advisable since only the aiming errors, i.e., only the internal behavior of the weapon system, are to be tested using the method.

In the new method, the steps described above are performed continuously and preferably clocked, which is to be understood to mean that the calculation steps for the value pairs of due instants/due positions are performed in calculation instants which are separated from one another by very small and preferably equal intervals of time. The image reproduction device therefore displays the aiming errors of the weapon system continuously for an entire target trajectory.

Each due instant is preferably calculated starting from a calculation instant and is therefore generally not coincident with one of the following calculation instants. For aiming of the weapon barrel in a calculation instant, the corresponding due position must therefore generally be determined by interpolation between due positions, whose associated due instants lie near this due instant associated with the calculation instants.

In the new method, the difference of the locations of the fire control device and the weapon must be taken into consideration for the calculations. The method may also be performed if the weapon moves in relation to the fire control device, i.e., is mounted on a traveling tank, for example. In this case, the changing weapon position must be measured continuously and taken into consideration in the calculations.

The forward movement of a weapon in relation to the fire control device described above is not to be confused with oscillatory motions of a weapon which is located on a moving platform, for example on board a ship or tank. Weapons on ships and tanks may perform both forward movements and oscillatory and shaking motions. The ship and/or tank typically has stabilization facilities for compensating such oscillatory motions. In the new method, oscillatory motions which are to be compensated by stabilization facilities are not taken into consideration in the calculations. This means that the test system according to the new method comprises not only the functions of the weapon system between the tracking of the target and the aiming of the weapon barrel, while taking the lead calculation into consideration, but also includes the effect of the stabilization facilities.

For judging the results of the new method, it must be considered that the accuracy performance of the weapon system is generally rather better than may be assumed on the basis of the images appearing on the image reproduction device, firstly, because the antiaircraft guns used as weapons usually have multiple weapon barrels, secondly, because multiple weapons are usually assigned to a fire control device in a weapon system, and thirdly, because spread may always be expected when firing with real shells. However, it must also be considered that the new method does not take external ballistics, which may negatively influence the accuracy performance, into consideration.

To perform the method described above, an image recording device and an image reproduction device, connected to the image recording device via a connection device, are used. Furthermore, a data processing unit having the necessary software and a memory unit must be available.

In a preferred exemplary embodiment of the present invention, the image reproduction device is connected to the image recording device in such a way that the images recorded may be immediately displayed continuously.

A video camera may be used as an image recording device, for example.

There are various variants for positioning the image recording device. Assuming at least approximately flat flight paths, the most precise test results are achieved if the optical axis of the image recording device is coincident with the weapon barrel axis. This is not possible in all mounting variants, but in principle the optical axis of the image recording device and the weapon barrel axis are to correspond as much as possible. A first variant is the attachment of the image recording device on or in the weapon barrel, in such a way that its optical axis coincides with the weapon barrel axis, i.e., corresponds to its direction and position. A second variant is the attachment of the image recording device onto the weapon barrel in such a way that its optical axis corresponds to the direction of the weapon barrel axis, but not its position. A third variant is the attachment of the image recording device onto the weapon barrel in such a way that its optical axis corresponds to neither the direction nor the position of the weapon of axis. In the second and the third variants of the attachment of the image recording device, the difference between the optical axis of image recording device and the weapon barrel axis may be established before beginning the actual method, for example, by using a calibrating camera attached in the center of the weapon barrel, and taken into consideration in the following method steps as a compensatory correction, either purely optically or through consideration in the calculations. Such a correction may be dispensed with if at least the difference of position between the optical axis of the image recording device and the weapon barrel axis is comparatively small in comparison to the distance between the weapon and the target.

If the image recording device is mounted in such a way that its optical axis coincides with the weapon barrel axis, it may be attached to the weapon only temporarily.

However, if the image recording device is mounted in such a way that its optical axis does not coincide with the position of the weapon barrel axis, it may also be permanently attached to the weapon. This is advantageous in that the method according to the present invention may then be performed at practically any time and without preparation; for example, it may be tested quickly whether failures in combating targets are caused by aiming errors of the weapon system or by unexpected target movements. The fixing must, however, be relatively robust, particularly if the image recording device is attached directly to the weapon barrel, since it is subjected to strong shaking during regular firing.

Typical suitable fixing means are used for mounting the image recording device on the weapon. It is preferably taken into consideration in this case that the weapon may be subjected to large temperature differences in the field.

Typically, a monitor is used as an image reproduction device. The image reproduction device is implemented in such a way that a mark, for example a reticule and/or coordinate system or a corresponding field is displayed during visualization of the images provided by the image recording device; the mark, i.e. the origin of the reticule and/or coordinate system and/or the corresponding field, represents the aiming line, which is to be understood to mean a line extending the weapon barrel axis. If the target coincides with the mark, there is no deviation and the aiming precision is perfect, which, however, does not exclude multiple errors arising in the control chain between tracking the target and aiming the weapon barrel, which, however, cancel out. The level of the deviation may be read out on the image reproduction device through additional markings and/or calibrations.

The connection device between the image recording device and the image reproduction device may be a typical cable connection, a glass fiber connection, or a non-material connection having a transmitter on the image recording device and a receiver on the image reproduction device. Non-material connection devices have the advantage that there is no cable tangling when the weapon barrel is pivoted around a large angle, possibly more than 360°. However, they malfunction easily. If material connection arrangements are used, which are less susceptible to malfunction, measures must be taken in order to prevent cable tangling in the event of wide angle pivots of the weapon barrel; for this purpose, jointly rotating contacts may be used or cables may be guided over a type of boom, for example.

Generally, the data processing unit assigned to the weapon system may be used as the data processing unit. This unit may be positioned exclusively on the fire control device or partially on the fire control device and partially on the weapon itself. A separate computer and/or memory unit, possibly separated from the weapon and fire control device, may also be used, which may also possibly be connected in modules.

As described above in more detail, the relative position, i.e. the distance and the relative angle, between the weapon and the fire control device must be known and taken into consideration in the calculations.

If both the weapon and the fire control device are fixed, this relative position is the constant gun parallax. The gun parallax must be determined before the beginning of the method. A position measurement device is used to determine the gun parallax. This may be a completely external device, like a triangulation device, or an internal device of the weapon system, or a device working together with a GPS.

The relative position between the weapon and the fire control device may, however, also change, for example, if the weapon is mounted on a moving vehicle, for example on a tank, while the fire control device is fixed. In this case, the continuous change of the relative position must be detected and taken into consideration continuously in the calculations which are performed while carrying out the method. The position measurement device may therefore not be a purely external device. The position measurement device is connected to the data processing facility and the software must be implemented for the purpose of considering the continuous change of the relative position in the calculations of the method.

BRIEF DESCRIPTION OF THE DRAWINGS

Further characteristics and advantages of the present invention are described in more detail in the following with reference to an example and in relation to the drawing.

DETAILED DESCRIPTION OF THE PREFERRED EMBODIMENTS

The method according to the present invention is described with reference to FIGS. 1 to 4; the procedures are described in a calculation instant Tc; in actuality, these calculations are performed continuously and/or repeatedly in multiple sequential calculation instants.

Figure 1:
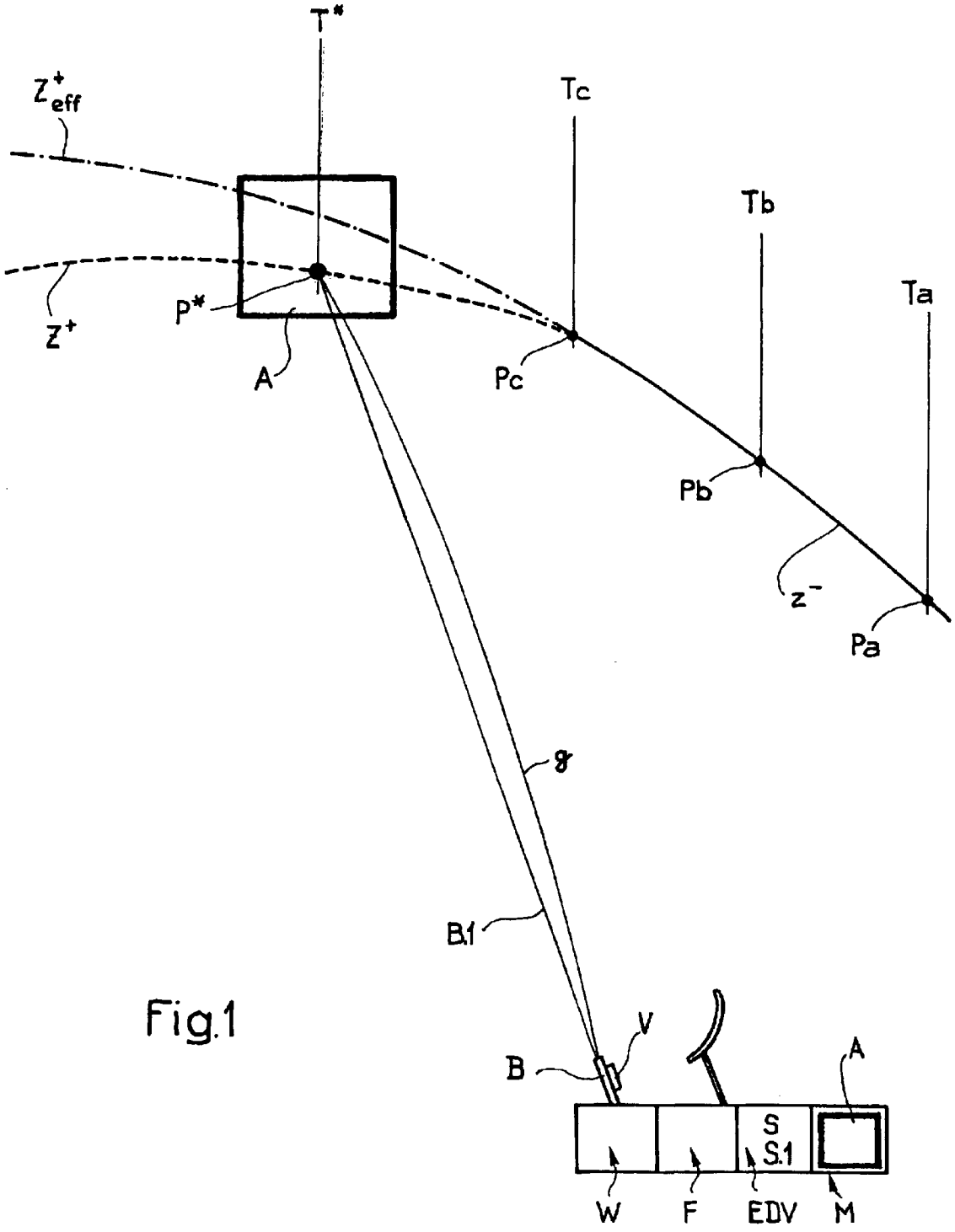
FIG. 1 shows a fixed weapon system, the fire control device and the weapon being located in the same position, as well as a target and a shell in various positions during the performance of the method.

FIG. 1 shows a weapon system whose aiming precision is to be checked and/or whose aiming errors are to be established. The weapon system has a fire control device F and a weapon W having a weapon barrel B and aiming means for aiming the weapon barrel; for the sake of simplicity, it is assumed that fire control device F and weapon W are located at the same position. The weapon barrel axis and its extension going beyond weapon barrel B are indicated with B.1. The weapon is assigned a data processing facility EDV having software S necessary for typical firing operation.

For performing the method according to the present invention, weapon system W has an image recording device V, an image reproduction device M and a computer unit having specific software S.1.

Image recording device V is, for example, a video camera. Image recording device V is intended for the purpose of recording images of the space which lies in front of weapon barrel B. For this purpose, image recording device V is positioned in such a way that it carries out the aiming motions of weapon barrel B in solidarity with weapon barrel B. Image recording device V is positioned, preferably on weapon W and/or on or in weapon barrel B, in such a way that its optical axis coincides precisely with weapon barrel axis B.1 or differs so slightly from weapon barrel axis B.1 that this difference is insignificant for the results of the method according to the present invention. Alternatively, image recording device V may also be positioned in such a way that the direction and/or position of its optical axis does deviate to a not insignificant degree from weapon barrel axis B.1, but this deviation is detected and compensated within the method according to the present invention.

Image reproduction device M is, for example, a monitor. It is connected to image recording device V and is intended for the purpose of displaying the images recorded by image recording device V.

The computer unit may be integrated into data processing facility EDV; this arrangement is generally typical and also used in the example described; the function of the computer unit is therefore taken care of by data processing facility EDV of the weapon system, which is present in any case, so that only specific software S.1 is also needed.

FIG. 1 also shows a target Z, which has assumed position Pa at instant Ta and position Pb at instant Tb and will assume position Pc at instant Tc. Target Z moves on a target trajectory; in FIG. 1, section z−, the section of the target trajectory which the target flew through before instant Tc, is illustrated by a solid line, while section z+ of the target trajectory, which will presumably be flown through after instant Tc, is illustrated by a dashed line; a dot-dash line represents section z+eff of the target trajectory, which the target actually will fly through after instant Tc, but which is not yet known at instant Tc.

Target Z is tracked by fire control device F, and the movement state of target Z is established at the same time. Target Z has position Pa at instant Ta and the associated movement state, and position Pb at instant Tb and the associated movement state. In instant Tc, processing facility EDV, which is assigned to the weapon system, retrospectively calculates the movement state of target Z, which contains section z− of the target trajectory, up to instant Tc.

In instant Tc, which is assumed as a calculation instant, a lead calculation is performed in a way known per se. On the basis of the established movement states of target Z, data processing facility EDV calculates the expected future movement state of target Z, which corresponds to target trajectory z+, through an extrapolation. A due instant T* and an associated due position P* are established in such a way that a shell G, which was fired at instant Tc from a weapon barrel B of a weapon W, would arrive at due position P* in due instant T*. The shell speed and the internal ballistics of shell P are taken into consideration in the calculation. If there is a difference of the position of weapon W from the position of fire control device F, i.e., a gun parallax, then this difference must also be taken into consideration in the calculation. At this due instant T*, target Z is also expected near corresponding due position P*. Target Z will presumably not precisely reach expected due position P*, because its actual movement state generally does not correspond to the calculated movement state, so that actual target trajectory z+eff does not coincide with expected target trajectory z+ or is not flown through at the time calculated.

The lead calculation is performed continuously in sequential calculation instants. Value pairs T*,P* established for respective associated due instants T* and due positions P* of target Z are stored in a memory of data processing facility EDV in a type of table. This table is continuously updated on the basis of further establishments of movement states of target Z, which flies further on section z+eff of the target trajectory. As soon as due instant T* is reached, weapon barrel B is aimed at due position P*. However, in general, due instant T* does not exactly coincide with one of the calculation instants. In this case, the calculation instant directly following due instant T*, which does not belong to one of the stored value pairs, is used as the due instant. The due position associated with this instant, which, of course, also does not belong to one of the stored value pairs, is then determined by interpolation between value pair T*/P* and a value pair neighboring it from the stored value pairs of due positions and due instants. If a real shell G was fired at due position P* in instant Tc, it would fly along a shell trajectory g and would arrive at due position P* in due instant T*. Target Z is located in surroundings A of this due position P* in due instant T*, so that a hit would occur with some certainty, if shell G had actually been fired. Software S.1 is used for these calculations.

The aiming of weapon barrel B at the respective due position during firing is typically performed at the beginning of the shell flight duration and for the purpose of firing a shell; according to the present invention, the aiming of the weapon barrel is only performed at the end of the shell flight duration and therefore in the due instant for the purpose of recording an image.

In due instant T*, a signal is made available by data processing unit EDV, on the basis of which the aiming means of weapon barrel B aim at due position P*. An image of this due position P* and its surroundings A is recorded by image recording device V in due instant T*. This image is visualized with the aid of image reproduction device M. The aiming of weapon barrel B and the recording of the image is also performed continuously.

Figure 2:
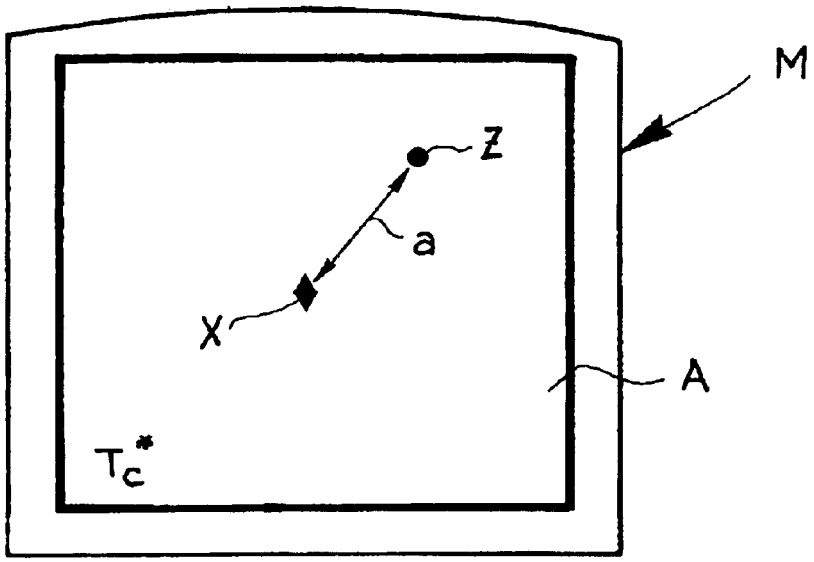
FIG. 2 shows an image reproduction device having a visualized image.

As shown in FIG. 2, a mark X, which represents the extension of weapon barrel axis B.1, may be seen on the visualized image of surroundings A. If shell G had been fired in instant Tc, this mark X would correspond to the end of shell trajectory g. Furthermore, the image of target Z, which is also indicated with Z, may also be seen on the visualized image at a certain deviation to mark X. Deviation a of the image of target Z from mark X is a gauge of the aiming error of the weapon system. If the weapon system had no aiming errors, the image of target Z and mark X would coincide.

Figure 3:
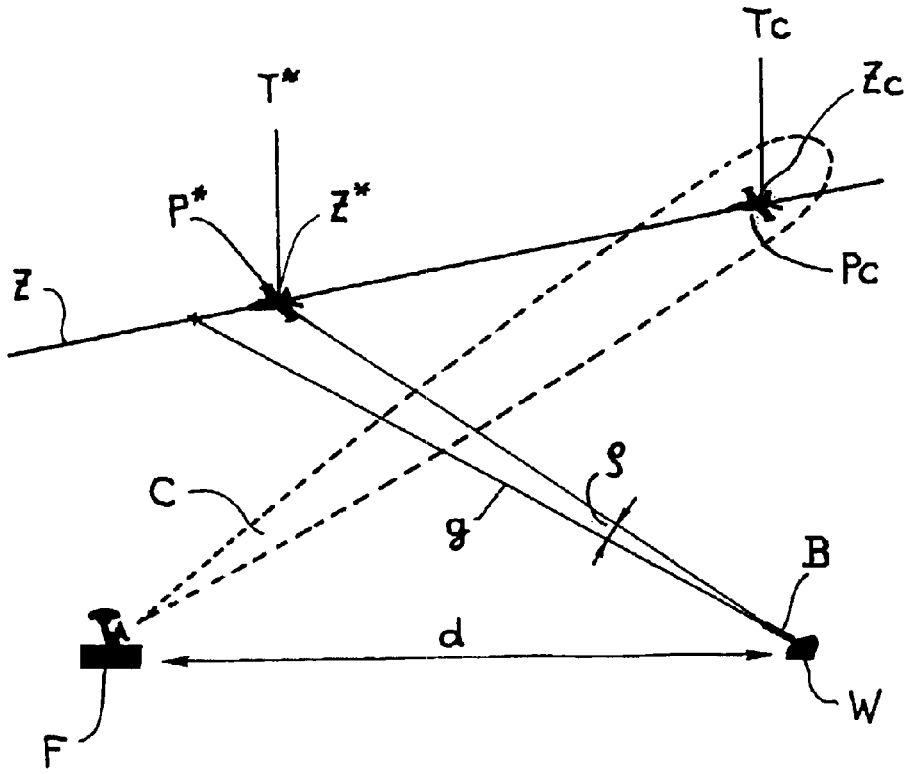
FIG. 3 shows a fixed weapon system, the fire control device and the weapon not being located in the same position, as well as a target and a shell in various positions during performance of the method.
Figure 4:
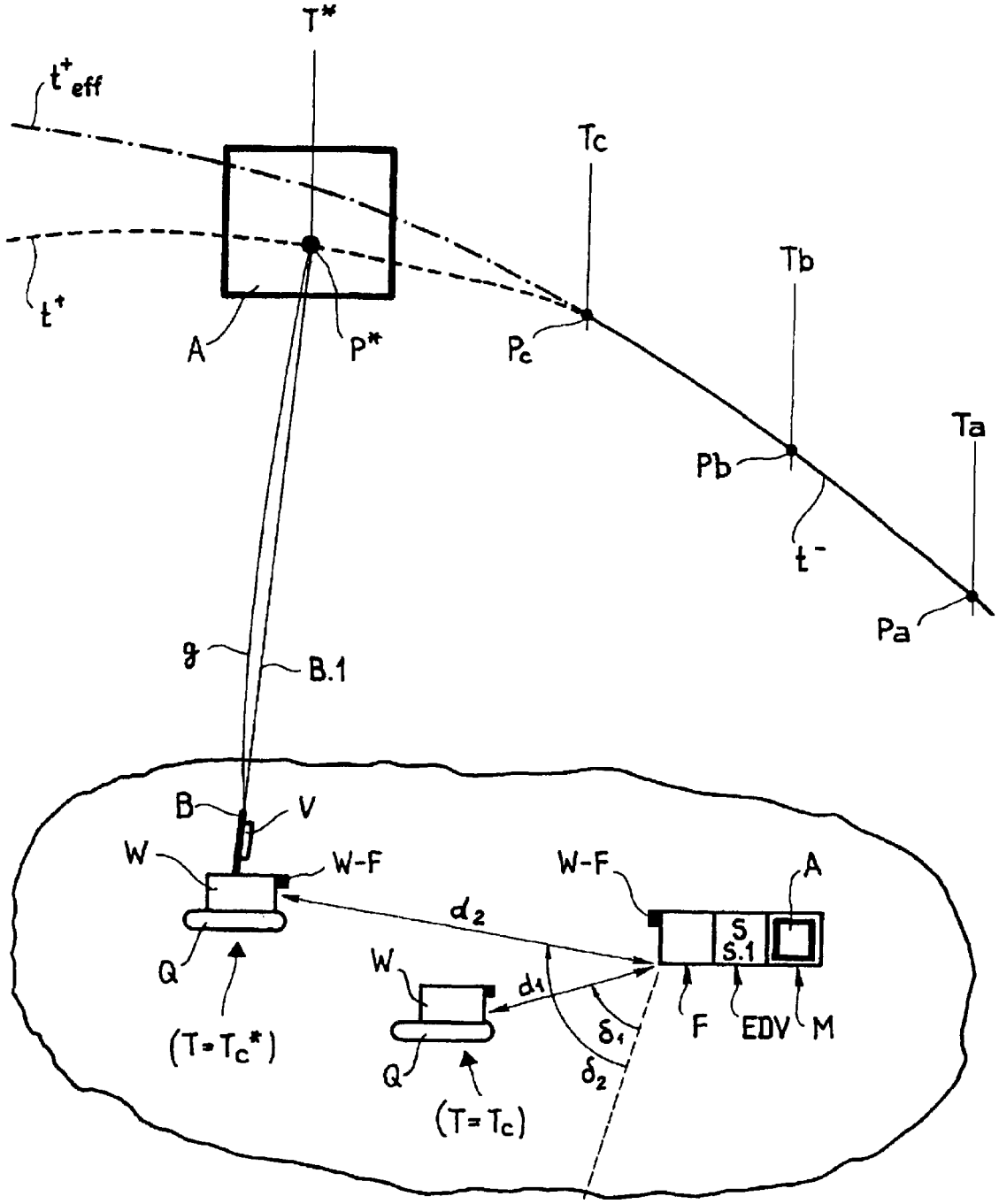
FIG. 4 shows a weapon system having a weapon mounted on a moving vehicle in two positions and a fixed fire control device, as well as a target and a shell in various positions during performance of the method.

The procedures described above are illustrated once again with the aid of FIG. 3, which is not to scale, however, it is assumed here that a distance d lies between fire control device F and weapon W. The relative position of fire control device F and weapon W is measured by a position measurement device W-F, which is illustrated in FIG. 4; this may be an internal position measurement device of the weapon system or a completely external position measurement device. At instant Tc, fire control device F, and/or its search and tracking unit, is active in a region C, target Z is located at position Pc and weapon barrel B would be aimed at due position P*, if there was the intention of firing a shell G; this shell G would still be in weapon barrel B at the beginning of its shell trajectory g, which it would fly through after firing. In due instant T*, i.e., after completion of the shell flight duration, during which shell G would be underway, target Z is near due position P* and weapon barrel B is aimed at due position P*. The aiming error is shown in FIG. 3 as angle ρ.

FIG. 4 shows a weapon system having a fixed fire control device F and a weapon W mounted on a moving vehicle Q, which is illustrated in two positions; distance d and relative angle δ between fire control device F and weapon W change over time; at instant Tc, they are d1 and δ1 and at instant T*, they are d2 and δ2. Weapon system W has an internal position measurement device W-F or a position measurement device W-F, which works together with a GPS, which is connected to data processing facility EDV. Software S.1 is also implemented for the purpose of considering the continuous change of distance d and relative angle δ between weapon W and fire control device F in the calculations.

What is claimed is:

1. A method for judging the aiming error of a weapon system, which has a fire control device for tracking a target, a weapon having a weapon barrel, aiming means for aiming the weapon barrel, and a data processing facility, the method comprising the steps of:

the fire control device tracking the target and the aiming means aiming the weapon barrel, an image recording device, which is moved in solidarity with the weapon barrel, repeatedly recording images of the target and its surroundings, and an image reproduction device displaying images recorded by the image recording device and a mark, this mark representing a point of an aiming line of the weapon, a deviation of an image of the target from the mark representing the aiming error of the weapon system, and the aiming of the weapon barrel being performed on the basis of a lead calculation which takes into consideration the movements of the target and a shell.

2. The method according to claim 1, characterized in that the fire control device repeatedly performs measurements while tracking the target, in order to detect positions of the target and instants at which the target assumes these positions, the data processing facility, in an instant selected as a calculation instant, continuously calculates the current movement state of the target, based on the measurements of the fire control device, calculates the expected future movement state of the target, based on the current movement state of the target, determines due instants and associated due positions, taking into consideration a difference of the positions of weapon and fire control device as well as the speed and the internal ballistics of usable shells, in such a way that, in the due instant, a shell which was fired in the calculation instant would arrive at the due position and the target is expected in the surroundings of the due position, upon reaching an aiming instant, makes a signal available to the aiming means of the weapon barrel, and the weapon barrel is aimed at the associated due position at latest in the due instant, the deviation corresponding to an aiming error which takes the lead calculation into consideration.

3. The method according to claim 2, characterized in that the aiming instant coincides with the due instant.

4. The method according to claim 1, characterized in that delays caused by the method are taken into consideration in calculations.

5. The method according to claim 1, characterized in that the difference of the position of the weapon from the position of the fire control device is measured repeatedly and changes of this difference are continuously considered in the calculations.

6. The method according to claim 1, characterized in that a deviation between a weapon barrel axis and an optical axis of the image recording device is established and this deviation is taken into consideration in the representation of the images recorded by the image recording device by the image reproduction device.

7. A device for judging the aiming errors of a weapon system, having:

fire control device for tracking a target, a weapon having a weapon barrel, aiming means for aiming the weapon barrel, and a data processing facility having software, the fire control device having a sensor device, in order to measure the respective positions of the target, and the data processing facility being implemented for the purpose of repeatedly calculating the current movement state of the target, repeatedly performing a lead calculation in an instant selected as a calculation instant, in order to establish a due instant and a due position, taking into consideration the current movement state of the target and taking into consideration the speed and the internal ballistics of usable shells, in such a way that, in the due instant, a shell which was fired in the calculation instant would arrive at the due position, and the target is expected in the surroundings of the due position, this device further comprising:

an image recording device, moved in solidarity with the weapon barrel, in order to record images of the target, an image reproduction device, in order to visualize the recorded images and a mark, this mark representing a point of an aiming line, a deviation of an image of the target from the mark corresponding to the aiming error of the weapon system, and additional software for the data processing facility, in order to make a signal available to the aiming means on the basis of the lead calculation, so that the weapon barrel is aimed at the due position in the due instant.

8. The device according to claim 7, characterized in that the weapon barrel is aimed at the due position in the due instant.

9. The device according to claim 7, characterized in that the image reproduction device is implemented and connected to the image recording device in such a way that the recorded images are displayed immediately.

10. The device according to claim 7, characterized in that the image recording device is a video camera.

11. The device according to claim 7, characterized in that the image recording device is positioned in such a way that an optical axis of image recording device coincides with a weapon barrel axis.

12. The device according to claim 7, characterized in that the image recording device is positioned in such a way that at least the direction and preferably also the position of an optical axis of the image recording device corresponds to the position of a weapon barrel axis.

13. The device according to claim 7, characterized in that the image recording device is temporarily attached to the weapon.

14. The device according to claim 7, characterized in that the image recording device is permanently attached to the weapon.

15. The device according to claim 7, characterized in that the image reproduction device is a monitor.

16. The device according to claim 7, characterized in that it includes a device for measuring a deviation of an optical axis of the image recording device from a weapon barrel axis, in order to compensate this deviation when the images made available by the image recording device are displayed.

17. The device according to claim 16, characterized in that the data processing unit is implemented for the purpose of performing calculations in order to determine the necessary compensations of the deviation of the optical axis of the image recording device from the weapon barrel axis when the images made available by the image recording device are displayed.

18. The device according to claim 7, characterized in that it has a position measurement device in order to continuously measure the change of the relative position of the weapon in the event of forward movement of the weapon relative to the fire control device, the data processing unit is implemented for the purpose of continuously considering the change of the relative position of the weapon in calculations.

19. The device according to claim 18, characterized in that the position measurement device is an internal device of the weapon system.

20. The device according to claim 18, characterized in that the position measurement device is a device which works together with external means.

21. The device according to claim 7, characterized in that the weapon is mounted on a vehicle and the fire control device is fixed.

22. The device according to claim 7, characterized in that the weapon and the fire control device are mounted on a vehicle.

23. The device according to claim 7, characterized in that the weapon is mounted on a vehicle which performs oscillatory and/or shaking movements and is stabilized relative to this vehicle with the aid of a stabilization device.

24. The method according to claim 4, wherein the delays include delays in the transmission of signals to the means for aiming the weapon barrel.

25. The device according to 20, wherein the external means is a GPS.

* * * * *